US007156253B2

(12) United States Patent
Ziegler

(10) Patent No.: US 7,156,253 B2
(45) Date of Patent: Jan. 2, 2007

(54) SINGLE-PIECE PAPER CUP SIP ADAPTOR

(76) Inventor: Scott W. Ziegler, 932 Vista del Monte Way, El Cajon, CA (US) 92020

( * ) Notice: Subject to any disclaimer, the term of this patent is extended or adjusted under 35 U.S.C. 154(b) by 169 days.

(21) Appl. No.: 10/390,388

(22) Filed: Mar. 17, 2003

(65) Prior Publication Data

US 2004/0056040 A1 Mar. 25, 2004

Related U.S. Application Data

(60) Provisional application No. 60/411,696, filed on Sep. 19, 2002.

(51) Int. Cl.
*A47G 19/22* (2006.01)
*B65D 55/16* (2006.01)

(52) U.S. Cl. ..... 220/375; 220/780; 220/717; 220/713; 229/404; 229/906.1

(58) Field of Classification Search ..... 220/254.3, 220/375, 711, 713, 717, 740, 836, 847, 700, 220/837, 780; 229/404, 906.1; 215/306, 215/387

See application file for complete search history.

(56) References Cited

U.S. PATENT DOCUMENTS 2,317,046 A * 4/1943 Fleming ..... 220/717
2,446,451 A * 8/1948 Allen ..... 215/11.1
2,620,085 A * 12/1952 Baldanza ..... 220/833
2,852,054 A * 9/1958 Motley ..... 220/834
2,949,204 A * 8/1960 Edwards ..... 215/321
2,958,439 A * 11/1960 Yochem ..... 220/834
3,235,117 A * 2/1966 Mason, Jr. ..... 215/256
3,297,187 A 1/1967 Thiesen
3,302,644 A * 2/1967 Kennedy et al. ..... 604/78
3,407,956 A * 10/1968 Linkletter et al. ..... 215/306
3,416,688 A * 12/1968 Fanning ..... 215/306
3,612,322 A * 10/1971 Linkletter ..... 215/225
3,690,498 A * 9/1972 Harbauer ..... 215/213
3,766,975 A 10/1973 Todd
3,787,547 A 1/1974 Stephan
3,851,783 A * 12/1974 Braginetz ..... 215/232
3,858,741 A * 1/1975 Smith, Sr. ..... 215/216
3,860,135 A * 1/1975 Yung et al. ..... 215/213
3,986,627 A * 10/1976 Zapp ..... 215/237
4,399,921 A 8/1983 Kusz
4,420,089 A * 12/1983 Walker et al. ..... 215/216
4,494,672 A * 1/1985 Pearson ..... 220/263
4,810,245 A * 3/1989 Aagesen ..... 604/78

(Continued)

*Primary Examiner*—Nathan J. Newhouse
*Assistant Examiner*—James Smalley

(57) ABSTRACT

An adaptor enables a child to drink from a cup having a bead extending around an open end of the cup. The adaptor has an annular collar that supports the cup by engaging a lower portion of a bead of the cup around a substantial portion of a periphery of the bead. A lid is removably engageable with the collar. The lid has an annular flange depending from a lower surface toward the collar with the flange being located to abut an interior side of the wall of the cup when the lid engages the collar to form a fluid seal with the cup. The lid has a channel formed therein and located between the flange and a periphery of the lid and encircling the flange. The channel encloses an upper portion of the bead of the cup. The lid has a child drinking spout on an exterior surface of the lid adjacent a peripheral edge of the lid. The spout is in fluid communication with the cup during use of the adaptor.

8 Claims, 2 Drawing Sheets

U.S. PATENT DOCUMENTS 4,844,270 A 7/1989 Coffman
4,850,496 A 7/1989 Rudell et al.
4,883,192 A * 11/1989 Krugman ..... 220/711
4,961,510 A * 10/1990 Dvoracek ..... 220/713
4,964,205 A 10/1990 Coffman
5,040,719 A * 8/1991 Ballway ..... 220/738
5,079,013 A 1/1992 Belanger
5,147,066 A 9/1992 Snider
5,467,888 A 11/1995 Brandstrom et al.
5,474,199 A * 12/1995 Julius et al. ..... 220/837
5,593,054 A * 1/1997 Glynn ..... 215/225
5,624,053 A * 4/1997 Freek et al. ..... 220/713
5,702,025 A 12/1997 Di Gregorio
5,720,408 A * 2/1998 Schmid et al. ..... 220/287
5,765,716 A * 6/1998 Cai et al. ..... 220/740
5,884,786 A 3/1999 Valyi
5,984,127 A * 11/1999 Fenton ..... 220/254.1
6,047,852 A * 4/2000 Evans et al. ..... 220/793
6,112,926 A 9/2000 Fishman
6,260,723 B1 * 7/2001 Bergholtz ..... 215/344
6,311,865 B1 * 11/2001 Laurent ..... 220/739
6,571,981 B1 * 6/2003 Rohlfs ..... 220/713
6,601,728 B1 * 8/2003 Newkirk et al. ..... 220/739
6,607,092 B1 8/2003 Manganiello et al.
6,622,882 B1 * 9/2003 Smith ..... 220/259.1
6,705,485 B1 3/2004 Sato et al.
6,755,318 B1 * 6/2004 Burke et al. ..... 220/703
2002/0158075 A1 * 10/2002 Caldicott et al. ..... 220/714
2003/0066839 A1 * 4/2003 Connors et al. ..... 220/288
2003/0192891 A1 * 10/2003 Ziegler ..... 220/288
2004/0005511 A1 * 1/2004 Flink et al. ..... 220/258.3

* cited by examiner

SINGLE-PIECE PAPER CUP SIP ADAPTOR

CROSS-REFERENCE TO RELATED APPLICATION

This application claims the benefit of U.S. Provisional Application No. 60/411,969, filed Sep. 19, 2002, the entire content of which are hereby incorporated by reference.

FIELD OF THE INVENTION

The present invention relates generally to drink cups for infants, and more particularly to a sip adaptor specifically sized and configured for retrofit attachment to a conventional paper drink cup.

BACKGROUND OF THE INVENTION

Most parents of infants and young children are very familiar with drinking cups often referred to as "sippy" or "sip" cups. Sip cups as currently known in the art typically comprises a cup portion which is fabricated from a plastic material and formed in the same general shape as a conventional paper drinking cup. In addition to this cup portion, the sip cup includes a lid which is engageable to the top rim of the cup portion. The lid itself typically includes an elongate spout which protrudes from a peripheral portion of the top surface thereof and includes a flow opening therein which fluidly communicates with the interior of the sip cup. In certain sip cups, the lid is threadably engaged to the cup portion, i.e., the cup portion is formed to include external threads about the rim thereof, with the lid being internally threaded with complementary threads. In other sip cups, the lid is frictionally engaged to the cup portion. The lid of some sip cups is provided with a valve arrangement which allows liquid to be drawn out of the flow passage of the spout when suction is applied thereto, but otherwise prevents liquid from spilling or dripping out of the spout when the sip cup is turned upside down or on its side and no suction is being applied to the spout.

In eating establishments where young children or toddlers are often found (e.g., fast-food restaurants, amusement park concession stands, etc.), it is the typical practice that a beverage is provided in a paper drinking cup. The paper drinking cup is typically provided with a plastic lid enclosure on one end thereof to contain the liquid within the cup, the lid enclosure including a slit for accommodating the advancement of a straw therethrough into the interior of the cup. Oftentimes, a toddler cannot be trusted to drink out of the cup/straw arrangement since there is still a high susceptibility for the lid enclosure to be dislodged from the cup and the contents spilling over the toddler. As such, it is a common practice for parents to pour the contents of the paper drinking cup into the cup portion of a sip cup, thereafter re-attaching the lid to the cup portion of the sip cup. The sip cup filled with the beverage is typically easier for the toddler to handle, and has substantially less susceptibility to spillage.

However, the initial transfer of the beverage from within the paper cup into the cup portion of the sip cup itself creates a susceptibility to accidental spillage. The present invention addresses this problem by providing a paper cup sip adaptor which is specifically sized and configured for retrofit attachment to a conventional paper beverage cup and provides the functional attributes of the lid of a sip cup.

SUMMARY

An adaptor is provided to enable a child to drink from a cup. The adaptor uses a wall of the cup which has a bead extending around an open end of the cup. The bead is located on an exterior surface of the cup. The adaptor includes an annular collar releasably engaged with a lid.

The annular collar has a top surface extending between an inner and outer periphery. The inner periphery defines an opening sized to accommodate the cup. The opening is sufficiently smaller than the bead so that the bead engages the collar to hold the cup during use of the adaptor.

The lid has a recess or channel formed therein with a depending flange inward of the channel. The channel is configured and located to engage at least a portion of the bead when the lid is engaged with the collar. The flange is configured and located to extend into the open end of the cup and engage an inside of the wall of the cup during use of the adaptor. The collar, channel and flange cooperate to restrain movement of the cup during use of the adaptor and to provide a substantially fluid tight seal with the cup during use of the adaptor when the lid is engaged with the collar. The lid also has a spout on an exterior surface of the lid and offset from a center of the lid. The spout has at least one fluid outflow opening in the spout placed in fluid communication with an inside of the lid. The spout is sized to allow a child to drink from the spout during use of the adaptor, and form a sippy cup.

Preferably, but optionally, a flexible tether connects the lid and collar. Moreover, the top surface further advantageously, but optionally, comprises a recessed, lower engaging surface extending around the opening defined by the annular collar. The lower engaging surface abuts the bead 16 during use of the adaptor to hold the cup. Advantageously, but optionally, the lower engaging surface and the channel enclose a substantial portion of the bead of the cup when the lid is engaged with the collar during use of the adaptor. Preferably, but optionally, lower engaging surface and the channel enclose about ¾ or more of a surface of the bead of the cup when the lid is engaged with the collar during use of the adaptor.

The bead is advantageously substantially enclosed by the channel and collar and sealingly engaged with at least one of the flange and channel. The cup can be gripped, and the seal can be formed, in various ways. The flange and inner periphery of the collar are advantageously configured to be resiliently urged against each other so as to grip the wall of the cup between the flange and inner periphery when the lid is engaged with the collar during use of the adaptor. The flange and inner periphery of the collar could also be configured to be resiliently urged against each other so as to grip the wall of the cup between the flange and inner periphery when the lid is engaged with the collar during use of the adaptor. Moreover, the flange could be further configured to be resiliently urged against the wall of the cup when the lid is engaged with the collar during use of the adaptor.

There is preferably a latch on one of the lid or collar that engages the other of the lid or collar to provide a releasable latch holding the lid to the collar when the lid engages the collar. That ensures the cup is in sealing engagement with the adaptor to help prevent fluid from leaking out of the cup through the adaptor.

The improved adaptor also includes an annular collar for supporting the cup by engaging a lower portion of the bead of the cup around a substantial portion of a periphery of the bead. The collar cooperates with a lid that is removably engageable with the collar, the lid having an annular flange depending from a lower surface toward the collar. The flange is located to abut an interior side of the wall of the cup when the lid engages the collar. The lid has a recess or channel formed therein and located between the flange and a periphery of the lid and encircling the flange. The channel encloses a portion of the bead of the cup when the lid engages the collar during use of the adaptor. And of course the lid has a child drinking spout on an exterior surface of the lid adjacent a peripheral edge of the lid. The spout has holes therein that are in fluid communication with a lower surface of the lid to place the spout in fluid communication with the cup during use of the adaptor. There is also preferably, but optionally, a flexible tether connecting the lid and collar, with the lid, tether and collar preferably being integrally molded of plastic, preferably PVC, although any other plastics suitable for holding beverages consumed by humans, can be used.

In this embodiment, the bead of the cup is substantially enclosed by the channel and collar and sealingly engaged with at least one of the flange and channel and inner periphery of the collar. There are preferably means for releasably holding the lid engaged with the collar. The lid is releasably held to the collar by a releasable latch that uses a bead extending around an outer periphery of the lid and located to engage a mating lip on the collar to releasably latch the lid to the collar.

The adaptor of claim 13, wherein the collar comprises an inner periphery inclined at an angle complementary to the angle of the wall of the cup and a recess having an arcuate cross-section configured and located to engage a lower portion of the bead of the cup.

In a further embodiment, the adaptor includes an annular collar having an inner periphery defining a circular opening through which a body of the cup extends. The collar is configured to engage a lower portion of the bead of the cup around a substantial portion of a periphery of the bead to support the cup when the cup is placed in the collar during use of the adaptor. A lid is provided that has a depending annular flange with the lid being placed over the collar and engaged with the collar so the flange wedges the wall of the cup between the flange and collar adjacent the bead to grip the cup when the lid engages the collar during use of the adaptor. The lid has a child drinking spout as described above.

In a still further embodiment, the adaptor may be viewed as including an annular collar cooperating with a lid to grippingly engage opposing sides of at least one of the bead and the wall of the cup adjacent the bead of the cup. The gripping engagement is with sufficient force to provide a fluid tight seal around the open end of the cup. At least one of the collar and lid have a recess enclosing a portion of the bead around the entire opening of the cup, with the collar and lid cooperating to enclose a substantial portion of the bead around the entire opening of the cup during use of the adaptor. The lid is releasably fastened to the collar by a frictional latch, with the lid having a child drinking spout. There is also preferably provided a tether joining the lid and collar, the tether being integrally molded with the lid and collar.

This invention further comprises a method for enabling a child to drink from a cup where the cup has a wall with a bead extending around an open end of the cup. The bead is located on an exterior surface of the cup. The adaptor includes. The method includes supporting a lower portion of the bead on an annular collar having an inner periphery defining an opening through which a body of the cup extends. The method also encloses an upper portion of the bead with a lid having a channel that encloses the bead. The method further fastens the lid to the collar and provides a fluid seal between the lid and the cup. Finally, the method provides a child drinking spout on the lid, the spout having an opening in fluid communication with the cup.

The method preferably, but optionally includes releasably fastening the lid to the collar by a snap-lock latch or other releasable fastening mechanism. The method also preferably includes tethering the lid to the collar. Advantageously, the tether is integrally and simultaneously molded with the lid and collar.

The step of providing a fluid seal preferably includes placing an annular flange that depends from the lid in frictional engagement with an inner surface of the wall of the cup. The step of providing a fluid seal preferably includes wedging the wall of the cup between the collar and an annular flange that depends from the lid. Alternatively, or additionally, the step of providing a fluid seal could include pressing the lid against the bead. The various features and advantages of this adaptor can be used in various combinations, especially in light of the further description provided herein.

BRIEF DESCRIPTION OF THE DRAWINGS

These, as well as other features of the present invention, will become more apparent upon reference to the drawings in which like numbers refer to like parts throughout, and wherein.

DETAILED DESCRIPTION

Referring to FIGS. 1–5 wherein the showings are for purposes of illustrating one embodiment of the present invention only, and not for purposes of limiting the same, the present invention is directed to a sip cup adaptor 10 which is adapted for retrofit attachment to a conventional paper beverage cup 12. The beverage cups 12 come in various sizes, such as 8 oz, 10 oz, 12 oz, etc., and if the diameter of the opening at the top of the cup changes, then a different sized adaptor 10 will be needed that matches the diameter of the cup 12.

Figure 3:
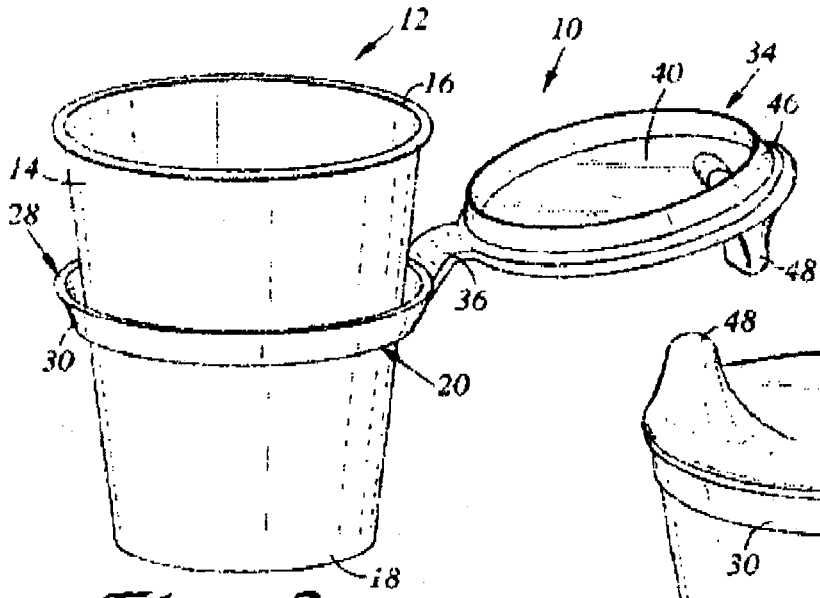
FIG. 3 is a top perspective view illustrating the manner in which the sip cup adaptor of the present invention is operatively interfaced to a conventional paper beverage cup.
Figure 4:
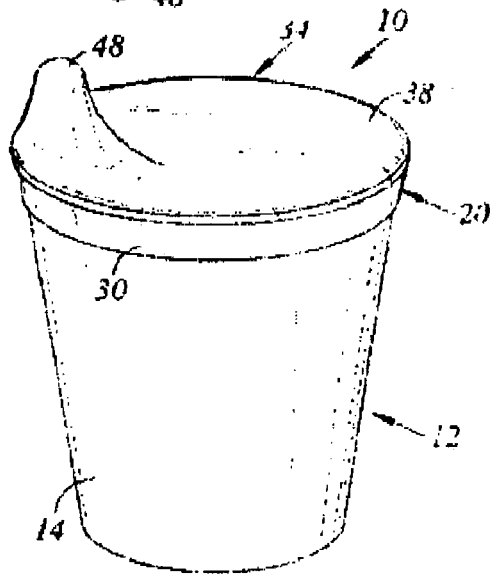
FIG. 4 is a top perspective view of the sip cup adaptor of the present invention as operatively interfaced to a conventional paper beverage cup, the lid portion of the sip cup adaptor being shown in a closed position.
Figure 5:
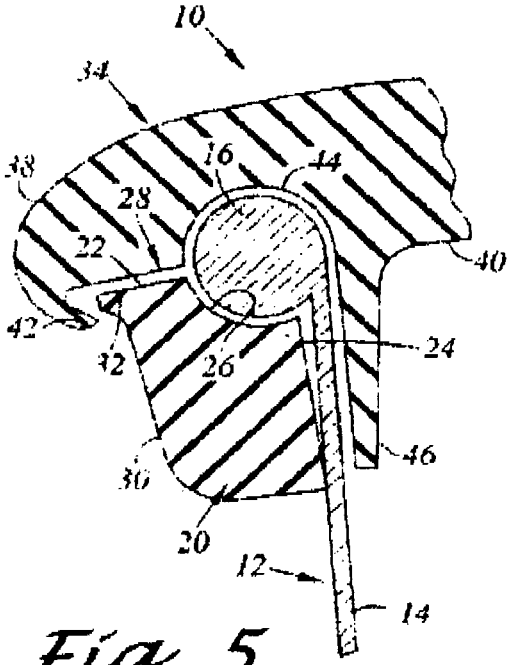
FIG. 5 is a partial cross-sectional view of the sip cup adaptor of the present invention, illustrating the manner in which the sip cup adaptor operatively engages a conventional paper beverage cup.

As best seen in FIGS. 3–5, such conventional beverage cups 12 comprises an outer wall 14 which has a generally frusto-conical configuration. Extending along the periphery of the open end of the outer wall 14 is a continuous, enlarged bead 16 which defines the rim of the beverage cup 12 and that encircles the opening that allows access to the inside of cup. The opposite end of the outer wall 14 is enclosed by a bottom wall 18. In accordance with conventional construction techniques, the bead 16 of the beverage cup 12 has a generally circular cross-sectional configuration. The cup 12, and bead 16, is typically made of a paper-based material coated with a sealant such as wax or plastic, or the entire cup may be made of plastic. As used herein, up, upper or top direction refers to the direction along an axis extending from the bottom of the cup 18 toward the top of the cup 16, which direction is generally vertical when the bottom 18 rests on the ground. As used herein, the term inner or inward refers to a direction generally toward the inside of the cup 12 and preferably toward a longitudinal axis of the cup 12 which axis passes through the center of the adaptor 10. The term outer or outward indicates a direction away from that centerline.

As seen in FIGS. 1–5, the adaptor 10 of the present invention comprises an annular collar portion 20. As best seen in FIG. 5, the collar portion 20 defines a top edge or surface 22 and a tapered inner surface 24, the slope or contour of which is configured to be complementary to the taper of the outer wall 14 of the beverage cup 12. Extending between the top and inner surfaces 22, 24 is an arcuately contoured, generally concave engagement surface 26. The top and engagement surfaces 22, 26 collectively define a top rim 28 of the collar portion 20, with the engagement surface 26 itself defining a groove or detent within the top rim 28 that is preferably, but optionally, continuous. The collar portion 20 also defines an outer surface 30. The top and outer surfaces 22, 30 each extend to a collar lip 32 of the collar portion 20. The lip 32 extends radially outwardly relative to the outer surface 30 thereof.

Figure 1:
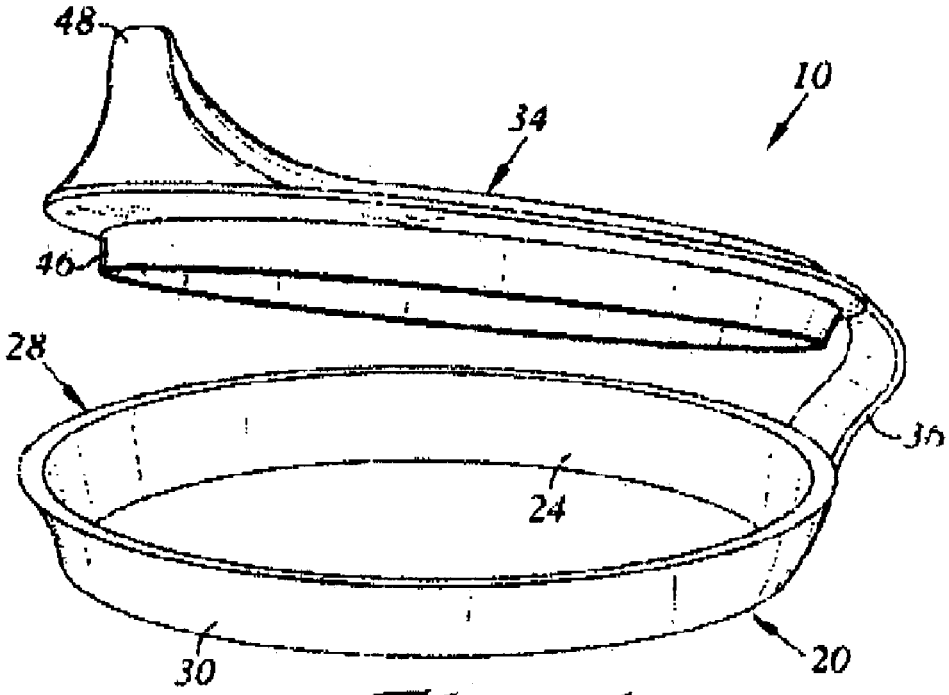
FIG. 1 is a top perspective view of a sip cup adaptor constructed in accordance with the present invention, illustrating the lid portion thereof in an open position.
Figure 2:
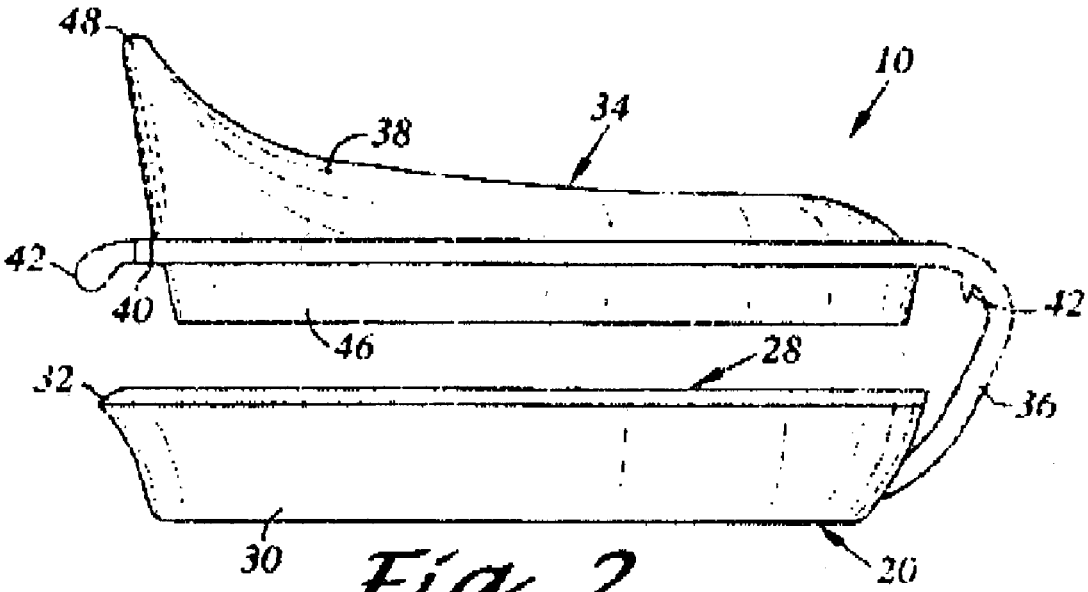
FIG. 2 is a side elevational view of the sip cup adaptor of the present invention, illustrating the lid portion thereof in the open position.

In addition to the collar portion 20, the adaptor 10 includes a circularly configured lid portion 34. As best seen in FIGS. 1–3, the lid portion 34 is integrally connected to the collar portion 20 via a flexible tether portion 36 extending therebetween. One end of the tether portion 36 is integrally connected to the outer surface 30 of the collar portion 20. The lid portion 34 defines an outer surface 38 and an opposed inner surface 40.

As best seen in FIG. 5, the outer surface 38 includes an arcuate, generally convex portion which defines the peripheral edge or rim of the lid portion 34. Additionally, the outer and inner surfaces 38, 40 extend to and collectively define a lid lip 42 which is angled or sloped radially inwardly relative to the peripheral rim of the lid portion 34 defined by the outer surface 38 thereof. Formed within the inner surface 40 is a continuous, annular recess 44 that preferably takes the form of a groove or channel and which preferably, but optionally, has a generally semi-circular cross-sectional configuration.

The lid portion 34 further includes a member that helps position and hold the cup 12, and advantageously also provides a fluid tight seal with the cup 12. The member can take various shapes but preferably comprises an annular member depending from the lid 34 and abutting the lip 16 or a wall of the cup 12. Advantageously, the member comprises an annular flange 46 which is integrally connected to and extends downwardly from the inner surface 40. The flange portion 46 is integrally connected to the inner surface 40 adjacent the edge of the channel 44 disposed furthest from the lid lip 42. In this regard, the outer peripheral surface of the flange portion 46 is substantially continuous with the concave portion of the inner surface 40 which defines the channel 44 of the lid portion 34.

The lid portion 34 of the adaptor 10 further includes a spout portion 48 which is integrally connected to and protrudes outwardly from the outer surface 38. Formed in the distal end of the spout portion 48 is one or more flow openings. The spout portion 48 is not centrally positioned upon the outer surface 38, but rather is offset toward the peripheral rim of the lid portion 34. A suitable spout is shown and described in U.S. Pat. No. 5,147,066, the complete contents of which are hereby incorporated by reference.

In the preferred embodiment, the adaptor 10 (including the collar, lid and tether portions 20, 34, 36) is fabricated from a plastic material, and is simultaneously molded in a one piece construction. As will be recognized, the tether portion 36 is fabricated to be of sufficient flexibility to allow the lid portion 34 to be moved relative to the collar portion 20 between an open position (shown in FIGS. 1–3) and a closed position (shown in FIGS. 4 and 5).

As best seen in FIGS. 3–5, the adaptor 10 is interfaced to or attached to the beverage cup 12 by sliding the collar portion 20 upwardly along the outer wall 14 of the beverage cup 12 toward the bead 16. As will be recognized, such interface occurs with the lid portion 34 in its open position so the lid does not block access to the passage of the cup 12 through the opening encircled by the collar 20. The advancement of the collar portion 20 along the outer wall 14 continues until such time as the enlarged bead 16 of the beverage cup 12 is brought into direct, abutting contact with the engagement surface 26 defining the detent within the top rim 28 of the collar portion 20.

As will be recognized, such interface may also be facilitated by advancing the beverage cup 12 into the collar portion 20 bottom wall 18 first. That is to say, the cup 12 can be dropped through the collar 20 until the bead 16 engages the engagement surface 26. The surface 26 of collar 20 thus engages a lower portion of the bead 16 to support the cup. The complementary tapers between the inner surface 24 of the collar portion 20 and the outer wall 14 of the beverage cup 12 helps to maintain the collar portion 20 in firm, frictional engagement to the beverage cup 12.

Once the collar portion 20 has been engaged to the beverage cup 12 in the above-described manner, the lid portion 34 may be moved from its open position that allows access to the opening encircled by the collar 20, to its closed position where the lid entirely covers the opening encircled by the collar. As best seen in FIG. 5, the movement of the lid portion 34 to its closed position results in the receipt of approximately the upper half of the bead 16 into the complementary channel 44 formed within the inner surface 40. Conversely, the channel 44 is located and sized to receive a portion of the bead 16 when the lid 34 is in the closed position.

As seen in FIG. 5, the channel 44 encircles about half the cross-sectional periphery of the bead 16, and does so for the entire length of bead 16 around the cup 12. As also seen in FIG. 5, the concave engagement surface 26 subtends an arc of about 90 degrees or greater, so the concave surface 26 encircles about ¼ or slightly more (because of the tapered cup) of the cross-sectional periphery of the bead 16. Between the concave surface 26 and the channel 44, about ¾ of the periphery of the cross section of the bead 16 is encompassed. As the concave surface 26 and channel 44 extend around the entire collar about ¾ of the surface of the bead 16 is adjacent to or abutting the surface 26 and channel 44. The channel 44 restrains the upper portion of the bead 16 while the concave surface 26 restrains a lower portion of the bead. Thus, a substantial portion of the bead 16 is captured within the detent collectively defined by the engagement surface 26 of the collar portion 20 and the channel 44 of the lid portion 34. By substantial is meant something over half, and preferably more than ⅔, and ideally about ¾ or more.

In addition to an upper portion of the bead 16 being partially received into the channel 44, the movement of the lid portion 34 to its closed position results in the advancement of the flange portion 46 along a portion of the inner surface of the outer wall 14 which is adjacent the bead 16. The advancement of the flange portion 46 along the inner surface of the outer wall 14 assists in preventing any inadvertent crushing of the beverage cup 12. Advantageously, but optionally, the flange 46 and inner surface 24 of collar 20 are angled slightly toward each other so they frictionally engage or grip the wall of the cup 12 between the flange 46 and inner surface 24. Because the wall of the cup 12 extends at a slight angle from the vertical, the actual angles of the flange 46 and inner surface 24 can vary while still achieving this gripping of the wall of the cup 12.

Advantageously the flange 46 and collar 20 advantageously grip the wall of cup 12 adjacent the bead 16, desirably within about ½ inch of the lip, and preferably as close as possible to the bead. The gripping preferably does not crush the bead 16 as that may create a location for fluid to leak from the cup 12 past the crushed portion.

Alternatively, but optionally, the inner surface 24 and flange 46 could be configured and located so that when the lid 34 is in the closed position, the inner surface 24 is spaced apart from the flange 46 by a distance that is less than the thickness of the wall of the cup 12 so as to grip the cup. One or both of the flange 46 and inner wall 24 may be slotted at intervals in order to provide more resilient segments and provide more flexible fingers or segments that resiliently grip the wall of the cup 12 between the parts.

It is preferred that the wall of the cup 12 be gripped and compressed rather than compressing and permanently deforming the bead 16. This arises in part because it is desirable for the flange 46 to cooperate with the wall of the cup 12 to provide a fluid seal preventing fluid from the cup from reaching the bead 16. This can be achieved by having the flange 46 resiliently urged against the wall of the cup 12. A further seal can be formed by resiliently urging the channel 44 against the bead 16.

It is believed possible to have a variety of constructions that restrain the cup 12 by engaging the bead 16 and sealing the bead 16 or adjacent portions of the cup. These include a loosely held bead 16 combined with a tightly gripped wall of the cup 12, or a tightly held and slightly compressed bead 16 combined with either a loosely held wall of the cup or a tightly gripped wall of the cup 12. It is preferable that the parts engage in a way so that the bead 16 not be permanently deformed as crushing the bead 16 makes it more likely that any liquid reaching the bead 16 may leak through the crushed portion.

It is also believed possible to have a fluid tight seal with the cup 12 be formed in various ways. These include wedging the annular flange 46 against the inside of the cup to form a fluid tight seal. Further, the wall of the cup 12 is preferably wedged -between the collar 20 and the flange 46 to form a fluid seal. Moreover, the lid can abut the bead 16 to form a fluid seal. Advantageously, the collar 20 and channel 44 cooperate to slightly squeeze the bead 16 and form a fluid tight seal. One or more of these sealing mechanisms can be used. There is thus advantageously provided means for providing a fluid tight seal with the cup 12.

The lid portion 34 is maintained in its closed position by a frictional latch that preferably, but optionally, takes the form of a snap lock achieved between the lid lip 42 of the lid portion 34 and the collar lip 32 of the collar portion 20. Other frictional based, releasable locking or temporary latch mechanisms can be used, including snaps, hook and loop fasteners, or frictional engagement of mating surfaces on the collar 20 and lid 34.

The firm engagement between the lid portion 34 and the collar portion 20 causes the combination of the beverage cup 12 and adaptor 10 to closely mimic the structural and functional attributes of a conventional sip cup, i.e., the beverage cup 12 satisfies the aforementioned cup portion element of the conventional sip cup. Once the beverage within the beverage cup 12 has been consumed by the toddler, the lid portion 34 may be moved to its open position to facilitate the re-filling of the beverage cup 12. Alternatively, the lid portion 34 can be moved to its open position, with the now empty beverage cup 12 simply being removed or "popped out" from within the collar portion 20. As will be recognized, with the adaptor 10 being positioned upon the beverage cup 12 in the above-described manner, liquid is drawn out from within the beverage cup 12 by the toddler sucking on the spout portion 48 of the lid portion 34.

The concave surface 26 thus provides means for retaining the cup 12 in the collar 20, and the surface in combination with the channel 44 provide further means for retaining the cup in the collar 20. The concave surface 26 and channel 44 also cooperate to provide means for providing a fluid seal around the bead 16. Likewise, the inner surface 24 and flange 46 provide means for providing a fluid seal around the periphery of the cup either by themselves, or in combination with the concave surface 26 and channel 44.

The adaptor 10 thus provides method and apparatus for enabling a child to drink from a cup 12 having a wall with bead 16 extending around an open end of the cup. The method includes supporting a lower portion of the bead 16 on an annular collar 20 having an inner periphery 24 defining an opening through which a body of the cup 12 extends. An upper portion of the bead 16 is enclosed with a lid 34, and preferably, but optionally, the lid has a channel that encloses the bead. The lid 34 is fastened to the collar 20, preferably, but optionally releasably fastened. A fluid seal is provided between the lid 34 and the cup 12. A child drinking spout 48 if formed on the lid 34, with the spout having an opening in fluid communication with the cup 12.

Advantageously, but optionally, the lid 34 is releasably fastened to the collar 20 by a frictional latch as described above. Moreover, the fluid seal can include includes placing the annular flange 46 that depends from the lid 34 in frictional engagement with the inner surface of the wall of the cup 12. A fluid seal can also be provided by wedging the wall of the cup 12 between the collar 20 and the annular flange 46 that depends from the lid 34. The fluid seal could also include pressing the lid 34 against the bead 16 of the cup 12.

Figure 6:
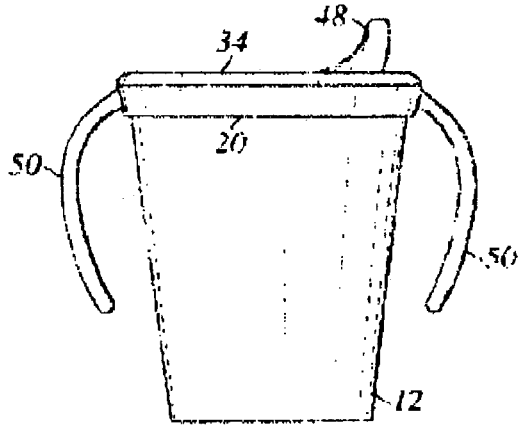
FIG. 6 is a frontal plan view of the sip cup adaptor of the present invention.

Referring to FIG. 6, in a further embodiment a handle 50 extends from the collar 20. The handle 50 preferably, but optionally, is slightly curved to provide more room for a child's hands to fit between the handle and the cup 12. The handle 50 thus extends laterally from the collar 20 along an axis radial to a centerline of the cup 12 and then curves to extend along a length of the cup 12. Because the cup 12 is tapered, the handle 50 can extend in a gradual arc without any prominent lateral section as shown in FIG. 6. Advantageously, but optionally, the handle 50 extends for about ½ to ¾ of a length of the cup 12. That allows a child to hold the handle at about the middle of the cup, near the center of gravity of the cup 12. A handle 50 extending a length of about 3–4 inches (76 mm–100 mm) along the length of a cup 12 is believed suitable.

The handle 50 is advantageously thick enough so it will not break under use and abuse by a child. A handle 50 with a circular cross section is preferred, and a smooth surface to avoid abrasion. But a textured gripping surface could be provided along the gripping areas of the handle. Knurling or slightly roughened areas along the straight portions are believed suitable.

Advantageously, there are two handles 50 extending from opposing sides of the collar 20. More than two handles 50 could be formed. If four, equally spaced handles are provided, then the cup 12 can rest on a lower two of the handles while being held by an upper two of the handles by a child. Advantageously the handles 50 are integrally molded with the collar 20, but the handles could formed separately from the collar 20 and then glued, welded, adhered or fastened to the collar. A variety of configurations for a handle 50 could be used and the depicted configuration is given for illustration, not limitation.

Those of ordinary skill in the art will recognize that various modifications to the adaptor 10 may be implemented without departing from the spirit and scope of the present invention. For example, the lid portion 34 of the adaptor 10 may be formed to include the above-described valve arrangement of prior art sip cups which prevents the spillage of liquid from the spout portion 48 unless suction is applied thereto. Such a valve is shown in U.S. Pat. No. 5,079,013, the complete contents of which are hereby incorporated by reference. Additionally, the inner surface 24 of the collar portion 20 need not necessarily be formed to have a tapered configuration.

Further, the taper of the inner surface 24 of the collar portion 20 may be formed to have a slope which provides for some measure or level of frictional retention to a wide variety of differently sized beverage cups 12. Along these lines, the collar portion 20 (and hence the lid portion 34) may be fabricated to be of differing diameters, depending on the particular size or size range of the beverage cup 12 with which the adaptor 10 is to be used. Still further, the collar lip 32 and/or lid lip 42 need not necessarily extend about the entire periphery or perimeter of the collar and lid portions 20, 34, respectively. In this regard, the collar and lid lips 32, 42 may be formed as segments which extend only partially about the collar and lid portions 20, 34, respectively, with the engagement of such smaller collar and lid lips 32, 42 to each other still effectively maintaining the lid portion 34 in its closed position.

Moreover, the concave surface 26 and channel 44 could extend around different portions of the periphery of the bead 16, as for example having the concave surface enclose the left half of the bead 16 as seen in FIG. 5, with the channel 44 enclosing the upper right quadrant or portion of the bead 16. Various other combinations could be used, with the surface 24 and channel 44 cooperating to restrain the cup by engaging the bead 16. Preferably, but optionally, the concave surface 24 and channel 44 enclose a substantial portion of the bead 16.

Still further, the concave surface 26 could be omitted, with the bead 16 being supported by a flat surface on the collar 20, or supported by a surface on the collar 20 having a shape other than concave. Advantageously though, the channel 44 and concave surface 26 are shaped to conform to the shape of the bead 16 so as to support the bead and restrain motion of the cup 12, so as to form a fluid seal with the bead 16, or both.

Additional modifications and improvements of the present invention may also be apparent to those of ordinary skill in the art. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

I claim:

1. An adaptor to enable a person to drink from a cup having a wall with a bead extending around an open end of the cup and located on an exterior surface of the cup, the adaptor comprising:

an annular collar having a top surface extending between an inner and outer periphery with the inner periphery defining an opening sized to accommodate the cup during use, the opening being sufficiently smaller than the bead so that the bead engages the collar to hold the cup during use of the adaptor;

a lid releasably engageable with the collar, the lid having a channel formed therein with a depending flange inward of the channel, the channel being configured and located to engage at least a portion of the bead when the lid is engaged with the collar, the flange being configured and located to extend into the open end of the cup and engage the wall during use of the adaptor, the collar, channel and flange cooperating to restrain movement of the cup during use of the adaptor and to provide a substantially fluid tight seal with the cup during use of the adaptor when the lid is engaged with the collar, the lid having an aperture on an exterior surface of the lid, with the aperture having at least one opening for fluid flow; and a flexible tether connecting the lid and collar;

wherein the top surface further comprises a recessed, lower engaging surface extending around the opening in the collar, the lower engaging surface abutting the bead during use of the adaptor to hold the cup.

2. The adaptor of claim 1, wherein the flange and inner periphery of the collar are configured to be resiliently urged against each other so as to grip the wall of the cup between the flange and inner periphery when the lid is engaged with the collar during use of the adaptor.

3. An adaptor to enable a person to drink from a cup having a wall with a bead extending around an open end of the cup and located on an exterior surface of the cup, the adaptor comprising:

an annular collar having a top surface extending between an inner and outer periphery with the inner periphery defining an opening sized to accommodate the cup during use, the opening being sufficiently smaller than the bead so that the bead engages the collar to hold the cup during use of the adaptor;

a lid releasably engageable with the collar, the lid having a channel formed therein with a depending flange inward of the channel, the channel being configured and located to engage at least a portion of the bead when the lid is engaged with the collar, the flange being configured and located to extend into the open end of the cup and engage the wall during use of the adaptor, the collar, channel and flange cooperating to restrain movement of the cup during use of the adaptor and to provide a substantially fluid tight seal with the cup during use of the adaptor when the lid is engaged with the collar, the lid having an aperture on an exterior surface of the lid, with the aperture having at least one opening for fluid flow; and a flexible tether connecting the lid and collar;

wherein the top surface further comprises a recessed, lower engaging surface extending around the opening in the collar, the lower engaging surface abutting the bead during use of the adaptor to hold the cup and, wherein the flange and inner periphery of the collar are configured to be resiliency urged against each other so as to grip the wall of the cup between the flange and inner periphery when the lid is engaged with the collar during use of the adaptor.

4. The adaptor of claim 1, wherein the flange is configured to be resiliency urged against the wall of the cup when the lid is engaged with the collar during use of the adaptor.

5. An adaptor to enable a person to drink from a cup having a wall with a bead extending around an open end of the cup and located on an exterior surface of the cup, the adaptor comprising:

an annular collar having a top surface extending between an inner and outer periphery with the inner periphery defining an opening sized to accommodate the cup during use, the opening being sufficiently smaller than the bead so that the bead engages the collar to hold the cup during use of the adaptor;

a lid releasably engageable with the collar, the lid having a channel formed therein with a depending flange inward of the channel, the channel being configured and located to engage at least a portion of the bead when the lid is engaged with the collar, the flange being configured and located to extend into the open end of the cup and engage the wall during use of the adaptor, the collar, channel and flange cooperating to restrain movement of the cup during use of the adaptor and to provide a substantially fluid tight seal with the cup during use of the adaptor when the lid is engaged with the collar, the lid having an aperture on an exterior surface of the lid, with the aperture having at least one opening for fluid flow; and a flexible tether connecting the lid and collar;

wherein the top surface further comprises a recessed, lower engaging surface extending around the opening in the collar, the lower engaging surface abutting the bead during use of the adaptor to hold the cup and wherein the flange is configured to be resiliently urged against the wall of the cup when the lid is engaged with the collar during use of the adaptor.

6. An adaptor to enable a person to drink from a cup having a wall tapered at an angle and having a bead extending around an open end of the cup and located on an exterior surface of the cup, the adaptor comprising:

an annular collar for supporting the cup by engaging a lower portion of the bead of the cup around a substantial portion of a periphery of the bead;

a lid removably engageable with the collar, the lid having an annular flange depending from a lower surface toward the collar, the flange being located to abut an interior side of the wall of the cup when the lid engages the collar, the lid having a channel formed therein and located between the flange and a periphery of the lid and encircling the flange, the channel enclosing a portion of the bead of the cup when the lid engages the collar during use of the adaptor, the lid having a drinking aperture on an exterior surface of the lid, with the aperture having at least one opening for fluid flow;

means for releasably holding the lid engaged with the collar;

a flexible tether connecting the lid and collar, the lid, tether and collar being integrally molded of plastic wherein the collar comprises an inner periphery inclined at an angle complementary to the angle of the wall of the cup and a recess having an arcuate cross-section configured and located to engage a lower portion of the bead of the cup.

7. An adaptor assembly for enabling a person to drink from a cup having a wall with a bead extending around an open end of the cup and located on an exterior surface of the cup, the adaptor comprising:

an annular collar having an inner periphery defining a circular opening through which a body of the cup extends, the collar being configured to engage a lower portion of the bead of the cup around a substantial portion of a periphery of the bead to support the cup when the cup is placed in the collar during use of the adaptor;

a lid having a depending annular flange, the lid being placed over the collar and engaged with the collar so the flange wedges the wall of the cup between the flange and collar adjacent the bead to grip the cup when the lid engages the collar during use of the adaptor, the lid having a drinking aperture on an exterior surface of the lid, with the aperture having at least one opening for fluid flow;

a flexible tether connecting the lid and collar; and an annular channel formed in the lid and located outward of the flange, the channel located and sized to enclose the bead of the cup and to abut at least a portion of the bead when the lid is engaged with the cup during use of the adaptor wherein the lid, tether and collar are integrally molded of plastic and, wherein the collar has a concave surface configured to receive the lower portion of the bead of the cup during use of the adaptor.

8. The adaptor of claim 7, further comprising means for releasably fastening the lid to the collar when the lid is engaged with the collar during use of the adaptor.

* * * * *